United States Patent [19]

Hackstein et al.

[11] Patent Number: 4,560,502

[45] Date of Patent: Dec. 24, 1985

[54] MOLDED BODY FOR EMBEDDING RADIOACTIVE WASTE AND PROCESS FOR ITS PRODUCTION

[75] Inventors: Karl Hackstein, Hanau; Milan Hrovat, Rodenbach; Thomas Schmidt-Hansberg, Frankfurt; Lothar Rachor; Hans Hüschka, both of Hanau, all of Fed. Rep. of Germany

[73] Assignee: Nukem GmbH, Hanau, Fed. Rep. of Germany

[21] Appl. No.: 440,344

[22] Filed: Nov. 9, 1982

[30] Foreign Application Priority Data

Nov. 11, 1981 [DE] Fed. Rep. of Germany ..... 3144764

[51] Int. Cl.[4] ..... G21F 9/16

[52] U.S. Cl. ..... 252/628; 264/0.5; 264/122

[58] Field of Search ..... 206/524.2, 524.9; 252/628, 633, 639, 502, 506; 427/5, 6; 376/411, 414, 416, 417; 264/0.5, 122

[56] References Cited

U.S. PATENT DOCUMENTS

| | | | |
|---|---|---|---|
| 2,969,294 | 1/1961 | Shyne | 427/5 |
| 2,990,352 | 6/1961 | Finniston et al. | 376/416 |
| 3,331,897 | 7/1979 | Accary et al. | 264/0.5 |
| 3,361,638 | 1/1968 | Bokros et al. | 427/6 |
| 3,753,854 | 8/1973 | Krauth et al. | 376/411 |
| 3,945,884 | 3/1976 | Freck | 376/411 |
| 3,994,822 | 11/1976 | De Bacci et al. | 427/6 |
| 4,022,663 | 5/1977 | Hrovat et al. | 376/411 |
| 4,134,941 | 1/1979 | Hrovat et al. | 264/0.5 |
| 4,257,912 | 3/1981 | Fleischer et al. | 206/524.2 |
| 4,271,101 | 6/1981 | Hrovat et al. | 264/0.5 |
| 4,407,742 | 10/1983 | Hrovat et al. | 252/628 |

FOREIGN PATENT DOCUMENTS

| | | | |
|---|---|---|---|
| 0057430 | 8/1982 | European Pat. Off. | 252/633 |
| 2208855 | 9/1973 | Fed. Rep. of Germany | 264/0.5 |
| 2917437 | 11/1980 | Fed. Rep. of Germany . | |
| 2942092 | 4/1981 | Fed. Rep. of Germany . | |
| 0571143 | 1/1980 | U.S.S.R. | 264/0.5 |

*Primary Examiner*—Ben R. Padgett
*Assistant Examiner*—Howard J. Locker
*Attorney, Agent, or Firm*—Cushman, Darby & Cushman

[57] ABSTRACT

For the longtime fixation of radioactive and toxic waste there are used molded bodies made of graphite with nickel sulfide as a binding agent. The molded bodies show especially good properties if the nickel sulfide is in the form of $Ni_3S_2$.

14 Claims, No Drawings

MOLDED BODY FOR EMBEDDING RADIOACTIVE WASTE AND PROCESS FOR ITS PRODUCTION

BACKGROUND OF THE INVENTION

The invention is directed to a molded body made of graphite having nickel sulfide as a binding agent for the safe longtime embedding of radioactive and toxic wastes, and a process for the production of such a molded body.

Spent fuel elements from nuclear reactors after a certain period of time of intermediate storage must be sent to a final disposal. Worldwide for this purpose, there have been tried two methods, namely the reprocessing of the fuel element with return of the fuel material for the preparation of the fuel elements as well as separation and final storage of the fission products (highly active waste) and alternatively the direct final storage of the spent elements. In each case, there is formed highly active waste which must be stored in suitable geological formations for 1000 years and longer. Also, other highly radioactive and highly toxic waste must be safely kept away from the biosphere.

There have been proposed numerous types of containers for the safe longtime confinement of such radioactive and toxic waste which fulfill well the necessary conditions such as tight confinement at the pressures and temperatures which occur or resistance to corrosion by salt liquors. As container material, there have been used numerous metallic and non-metallic materials.

Since graphite has an outstanding resistance to corrosion, it has been proposed (German OS No. 2942092) to provide containers with a corrosion protective layer made of graphite. Since graphite molded bodies which have the necessary dimensions for receiving a fuel element are produced in neither gas nor liquid tight condition, there is provided a connected coating of pyrolytic carbon or silicon carbide. After the filling in of the fuel element the coated container should be closed with a similarly coated gas and liquid tight cover. Thereby, graphite gaskets or suitable adhesive agents should be employed. A substantial disadvantage of this container concept is the extraordinarily high industrial expense which is necessary for the production and coating of containers having large dimensions. Besides such large molded bodies cannot be coated within the necessary quality specifications.

It is also known to produce molded bodies made of a carbon matrix for embedding radioactive and toxic wastes by pressing graphite powder with a binding agent. As binding agent, there is preferably used nickel sulfide (German OS No. 2917437 and related Hrovat U.S. application Ser. No. 143,941, filed Apr. 25, 1980, now U.S. Pat. No. 4,407,742 the entire disclosure of which is hereby incorporated by reference and relied upon). Such molded bodies are very dense, and possess a good corrosion and leach resistance, especially against salt solutions. However, in many cases the thus produced molded bodies do not have the optimum resistance to corrosion and salt solutions. In the Hrovat U.S. application (and German OS No. 2917437 ) Example 2, which is the only one employing sulfur and nickel powder and forming nickel sulfide there is used 20 parts of sulfur and 36.7 parts of nickel metal powder by weight (corresponning to 54.5 parts of sulfur to 100 parts of nickel). The properties of the molded article of Example 2 were:

Density of the binding matrix: 3.1 g/cm$^3$
Compressive strength: 73.8 MN/m$^2$
Heat conductivity: 0.28 W/cm.°K
linear coefficient of thermal expansion: 17.7 gm/m.°K Therefore it was the problem of the present invention or provide a molded body made of graphite having nickel sulfide as binding agent for the safe longtime embedding of radioactive and toxic wastes which exhibits the highest possible resistance to corrosion and leaching out.

SUMMARY OF THE INVENTION

This problem was solved according to the invention by having the nickel sulfide present preponderantly as $Ni_3S_2$. Preferably at least 80% of the nickel sulfide present in the graphite matrix is introduced as definite $Ni_3S_2$.

Graphite molded bodies treated with radioactive or toxic wastes, which graphite contains $Ni_3S_2$ as binding agent possess an extremely high corrosion and leach resistance in salt solutions.

It has proven favourable if the molded body besides the embedded wastes contains 25–90 weight % nickel sulfide ($Ni_3S_2$), especially 45–60 weight % nickel sulfide ($Ni_3S_2$), balance graphite. The certainty of the embedding of wastes against dissolving out chemically or mechanically furthermore can be improved if the waste is embedded in a nucleus which is surrounded by a waste free shell made of the same material.

The production of this molded body preferably is carried out by pressing a mixture of wastes, graphite powder, sulfur powder and nickel powder at a temperature above 100° C., whereby the nickel and sulfur powders are employed in the ratio which is necessary for formation of $Ni_3S_2$. Advantageously, per 100 grams of nickel powder there are added 35 to 45 grams of sulfur powder, since the sulfur, depending on the handling procedure, can be sublimed out of the molding composition to a slight extent. Preferred pressing temperatures are 400° C. to 500° C.

Because of the extremely high longtime resistance of the graphite—$Ni_3S_2$ matrix, this can also be used for embedding long life $\alpha$-emitters, as for example plutonium.

The compositions can comprise, consist essentially of or consist of the stated materials and the process can comprise, consist essentially of or consist of the recited steps with such materials.

Unless otherwise indicated, all parts and percentages are by weights.

The following example explains the invention in greater detail.

DETAILED DESCRIPTION

Example

As starting powder there are produced a mixture of 43.7 weight % finely powdered natural graphite, 15 weight % finely ground sulfur and 41.3 weight % nickel metal powder by dry mixing. Active waste was embedded in this mixture.

The completely molded body had the following properties:

Matrix density: 3.36 g/cm$^3$
Density: 97% of the theoretical density
Heat conductivity: 0.8 W/cm·K
Linear coefficient of thermal expansion: 9.2 $\mu$m/m·K
Compressive strength: 107 MN/m$^2$ The leach resistance in salt solutions was very good.

The entire disclosure of German priority application No. P 3144764.3 is hereby incorporated by reference.

We claim:

1. Radioactive or toxic waste embedded in a molded body of graphite having nickel sulfide as a binder for the safe longtime storage of the waste wherein more than 50% of the nickel sulfide and up to 100% of the nickel sulfide is present as $Ni_3S_2$ the nickel sulfide being preponderantly present as $Ni_3S_2$.

2. A molded body according to claim 1, wherein at least 80% of the nickel sulfide is present as $Ni_3S_2$.

3. A molded body according to claim 2, wherein besides the embedded waste the molded body consists of 25–90 weight % nickel sulfide, balance graphite.

4. A molded body according to claim 1, wherein besides the embedded waste the molded body consists of 25–90 weight % nickel sulfide, balance graphite.

5. A molded body according to claim 4, which consists essentially of a nucleus having the waste embedded in the graphite-nickel sulfide matrix, and a waste free surrounding shell of the same graphite-nickel sulfide matrix.

6. A molded body according to claim 3, which consists essentially of a nucleus having the waste embedded in the graphite-nickel sulfide matrix, and a waste free surrounding shell of the same graphite-nickel sulfide matrix.

7. A molded body according to claim 2, which consists essentially of a nucleus having the waste embedded in the graphite-nickel sulfide matrix, and a waste free surrounding shell of the same graphite-nickel sulfide matrix.

8. A molded body according to claim 1, which consists essentially of a nucleus having the waste embedded in the graphite-nickel sulfide matrix, and a waste free surrounding shell of the same graphite-nickel sulfide matrix.

9. A molded body according to claim 1 prepared from a mixture of 43.7 weight % natural graphite, 15 weight % sulfur and 41.3 weight % nickel metal, the molded body having the following properties:

Matrix density: 3.36 g/cm$^3$

Density: 97% of the theoretical density

Heat Conductivity: 0.8 W/cm·K

Linear coefficient of thermal expansion: 9.2 μm/m·K

Compressive strength: 107 MN/m$^2$.

10. A process for the production of a molded body containing bound radioactive waste or toxic waste comprising mixing radioactive or toxic waste with a mixture of graphite, sulfur, and nickel powders, the nickel and sulfur being employed in a ratio to preponderantly form $Ni_3S_2$ and molding at a temperature above 100° C.

11. A process according to claim 10, wherein per 100 grams of nickel powder there are employed 35–45 grams of sulfur powder.

12. A process according to claim 11, wherein the molding is carried out at 400° C. to 500° C.

13. A process according to claim 10, wherein the molding is carried out at 400° C. to 500° C.

14. A process according to claim 10 wherein there are employed nickel and sulfur in amounts such that more than 50% of the nickel sulfide formed and up to 100% of the nickel sulfide formed is present as $Ni_3S_2$.

* * * * *